US007740707B2

(12) United States Patent
Bertram et al.

(10) Patent No.: US 7,740,707 B2
(45) Date of Patent: Jun. 22, 2010

(54) METHOD FOR OPERATING A VACUUM CLEANER

(75) Inventors: Andre Bertram, Bielefeld (DE); Kai Buller, Glandorf (DE); Markus Druecker, Guetersloh (DE); Guenther Ennen, Enger (DE); Seyfettin Kara, Spenge (DE); Stephan Koch, Detmold (DE); Martin Kornberger, Bielefeld (DE); Stefan Tiekoetter, Bielefeld (DE); Dirk Wegener, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 967 days.

(21) Appl. No.: 11/468,227

(22) Filed: Aug. 29, 2006

(65) Prior Publication Data

US 2007/0044821 A1 Mar. 1, 2007

(30) Foreign Application Priority Data

Aug. 30, 2005 (DE) ..... 10 2005 041 133

(51) Int. Cl.
*B08B 7/04* (2006.01)
*B08B 5/04* (2006.01)

(52) U.S. Cl. ..... 134/18; 134/21; 15/319; 15/339; 15/345

(58) Field of Classification Search ..... 134/18, 134/21; 15/300.1, 119, 339, 319, 345
See application file for complete search history.

(56) References Cited

U.S. PATENT DOCUMENTS

| | | | | |
|---|---|---|---|---|
| 5,323,483 | A * | 6/1994 | Baeg | 388/811 |
| 5,507,067 | A * | 4/1996 | Hoekstra et al. | 15/319 |
| 5,867,800 | A * | 2/1999 | Leif | 701/23 |
| 5,907,886 | A * | 6/1999 | Buscher | 15/319 |
| 6,073,302 | A * | 6/2000 | Buscher | 15/339 |
| 2005/0210610 | A1 * | 9/2005 | Louie et al. | 15/102 |

FOREIGN PATENT DOCUMENTS

| | | |
|---|---|---|
| DE | 196 05 780 | 8/1997 |
| DE | 299 22 289 | 5/2000 |
| DE | 103 34 894 | 10/2004 |
| DE | 102005002420 | 7/2006 |
| EP | 0790030 | 8/1997 |
| WO | WO-2005/077243 | 8/2005 |
| WO | WO-2006077040 | 7/2006 |

* cited by examiner

*Primary Examiner*—Michael Barr
*Assistant Examiner*—Saeed T Chaudhry
(74) *Attorney, Agent, or Firm*—Leydig, Voit & Mayer, Ltd.

(57) ABSTRACT

A method for operating a vacuum cleaner having a fan, an electronic control system for the fan and/or another load, and a dust chamber for receiving an air-permeable dust bag, includes providing the dust bag with an identifier, and providing the vacuum cleaner with an identifying device associated with the electronic control system and configured to identify the identifier. When the identifier fails to be identified, at least one of the fan and the other load is controlled using the electronic control system so as to reduce at least one parameter associated with an intake of dust into the dust bag.

16 Claims, 2 Drawing Sheets

METHOD FOR OPERATING A VACUUM CLEANER

Priority is claimed to German patent application DE 10 2005 041 133.9, filed Aug. 30, 2005, which is hereby incorporated by reference herein.

The present invention relates generally to a method for operating a vacuum cleaner including a fan, an electronic control system for controlling the rotational speed or power of the driving motor of the fan and/or for controlling other loads, such as a display device, further including a dust chamber for receiving an air-permeable dust bag made of paper or non-woven fabric. The present invention relates specifically to a method for operating a vacuum cleaner where the dust bag has an identifier, and the vacuum cleaner being provided with a device associated with the electronic control system and used to identify the identifier.

BACKGROUND

The prior art describes vacuum cleaners, in which the dirt-laden suction air is first filtered through a disposable dust bag. In order to allow for easy insertion of the dust bag into the dust chamber, the bag is provided with a collar around the opening region of the inlet opening, said collar being inserted into a holder in the dust chamber. Dust bags are generally provided by the vacuum cleaner manufacturer or authorized suppliers. This allows for quality control, so that the dust bags are matched to the requirements of the respective vacuum cleaner in terms of tear-resistance, retention capacity, and other parameters. However, there are also available unauthorized, cheap dust bags that do not meet these requirements. For instance, when using a dust bag from a third-party manufacturer, it is not possible to prevent the vacuum cleaner from being damaged during use, for example, because a dust bag is destroyed during the operation of the vacuum cleaner. When using an unauthorized dust bag, it is also possible that the fan power does not produce its full effect.

The aforementioned problems may also occur when inserting an original dust bag that is authorized by the vacuum cleaner manufacturer, but whose size is not appropriate for the vacuum cleaner used.

DE 299 22 289 U1 describes a system for identifying and authenticating accessory, auxiliary and/or operating materials for technical equipment, said system allowing a vacuum cleaner to identify an unauthorized dust bag and to subsequently disable the operation. A user who may not know this function will suspect a technical fault, resulting in servicing costs. Moreover, the user is unacceptably limited in the selection of the dust bag, because he or she is unable to intentionally choose cheap dust bags.

SUMMARY

It is, therefore, an object of the present invention to provide a method for operating a vacuum cleaner which overcomes the above drawback while still reducing the risk of damage to the vacuum cleaner due to low-quality dust bags.

In an embodiment, the present invention provides a method for operating a vacuum cleaner including a fan, an electronic control system for controlling at least one of the fan and at least one other load, and a dust chamber for receiving an air-permeable dust bag. The method includes: providing the dust bag with an identifier; providing the vacuum cleaner with an identifying device associated with the electronic control system and configured to identify the identifier; and when the identifier fails to be identified, controlling at least one of the fan and the at least one other load using the electronic control system so as to reduce at least one parameter associated with an intake of dust into the dust bag.

BRIEF DESCRIPTION OF THE DRAWINGS

Exemplary embodiments of the present invention will be explained in more detail with reference to the following FIGS. 1 through 4, of which.

DETAILED DESCRIPTION

Figure 1:
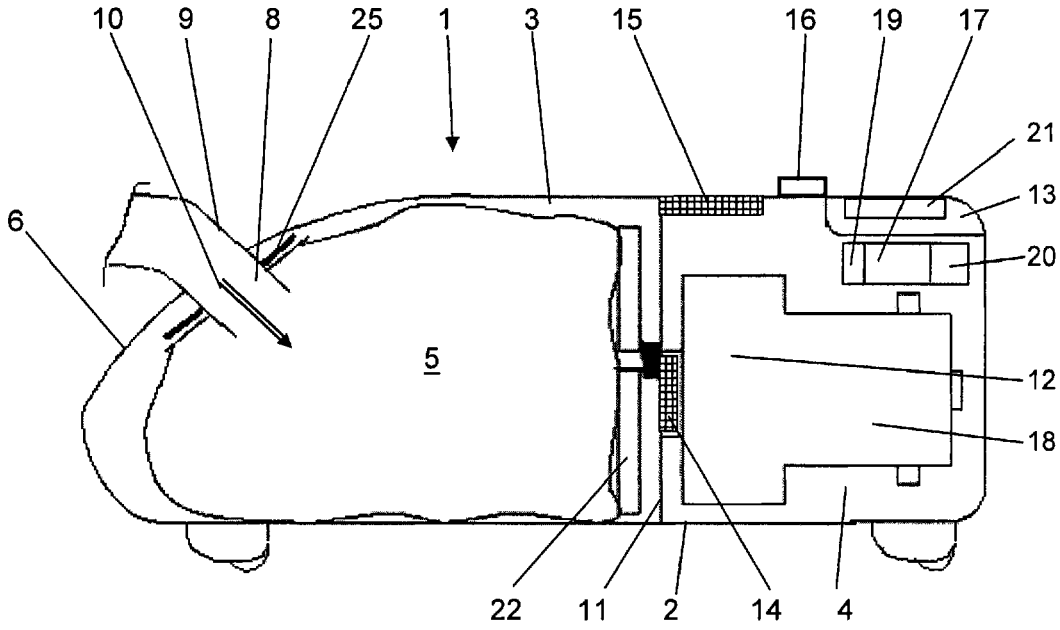
FIG. 1 is a cross-sectional side view showing a floor vacuum cleaner 1 in a schematic representation.

Because the dust bag is provided with an identifier that can be identified by a device located in the vacuum cleaner, and because if the identifier fails to be identified, the electronic control system controls the fan and/or the other loads in such a manner that at least one parameter determining the intake of dust into the dust bag, or a parameter dependent thereon, is reduced, it is ensured that the vacuum cleaner operates in a manner optimally adapted to the bag and that it produces its maximum power only when using authorized dust bags. The appropriate fan power can be adjusted either by a reduction, independently of the selected power, or such that the power is only a fraction of the selected value if a dust bag is inserted that is not identifiable, and thus not authorized.

Furthermore, customer annoyance caused by burst dust bags is avoided. Motor or exhaust filters are replaced at the appropriate time and, moreover, the dust bag replacement indicator works more reliably. Furthermore, the replacement indicator can be controlled as a function of the inserted dust bag. The maximum operating time is only reached by authorized dust bags, while products of inferior quality have to be replaced earlier. A dust-bag compression device located in the dust chamber can be deactivated, another option being to reduce the performance thereof. Moreover, information about the use of an unauthorized dust bag and about resulting failures can be stored in a non-volatile memory for the customer service department.

It is also possible to combine a sensor for detecting the amount of dust trapped (known from international application PCT/EP2005/000944, which is hereby incorporated by reference herein) with the manufacturer information on the dust bag. The information about the amount of dust trapped allows the dust bag replacement indicator to be controlled even more precisely. When detecting an unauthorized dust bag, the power of the appliance will be reduced. When the dust bag needs to be replaced, the size of the dust bag to be purchased is indicated by a display in order to avoid customer uncertainty about the appropriate size. The customer service department can read out whether authorized dust bags have been used, which may affect warranty claims of the customer.

In an embodiment, a transponder is used as the identifier, and a transmitter/receiver device activating the transponder is used as the device for identifying the identifier. This type of dust bag identification is inexpensive to implement and does not require any electrical wires to be routed from the dust bag mount to the electronic control system.

In another embodiment, a visual mark provided on the dust bag, in particular on a collar of the dust bag, can be used as the identifier, and a device for visual pattern recognition can be used as the device for identifying the identifier. In that case, the optically readable data carrier may also include, for example, a holographic company logo to be visually perceived. This allows the customer to see directly that he or she uses an accessory that is authorized by the manufacturer.

FIG. 1 shows a floor vacuum cleaner 1 in a schematic cross-sectional side view. Housing 2 of said vacuum cleaner is divided into a dust chamber 3 and a fan chamber 4. Dust chamber 3 serves to accommodate dust bags 5. To this end, a mounting member 25 for the collar of dust bag 5 is arranged inside dust chamber 3 in a manner generally known in the art (see, for example, German patent document DE 103 34 894 B3, which is hereby incorporated by reference herein). When cover 6 is closed, dust bag 5 is located with its inlet opening 7 (see FIG. 2) behind suction opening 8 of vacuum cleaner 1, a suction hose 9 (shown only fragmentarily) being connected to said suction opening. In order to allow the dirt-laden suction air (symbolized by arrow 10 in FIG. 1) to pass through dust bag 5, a motor-operated fan 12 is mounted in fan chamber 4, which is separated from dust chamber 3 by a partition 11, the suction side of said fan facing toward dust chamber 3. When fan 12 is on (switching on is done by a control button 13 provided for this purpose), the suction air flows through the inlet connector and through dust bag 5, where it is filtered, then passes through a motor filter 14, and is subsequently passed by fan 12 through an exhaust filter and is discharged as cleaned exhaust air into the environment. The fan power can be varied in a known manner by means of a power adjusting device, which is shown in FIG. 1 as a rotary selector switch 16. The power adjusting device interacts with an electronic control system 17 which controls the voltage of fan motor 18, thereby adjusting the engine speed. Moreover, a device 19 for identifying a later described identifier on dust bag 5 is integrated in electronic control system 17. Electronic control system 17 is also provided with a non-volatile memory 20. In addition to fan motor 18, the electronic control system also controls a display unit 21, which may be provided with replacement indicators for dust bag 5, motor filter 14 and exhaust filter 15. As shown in FIG. 1 and described in the currently unpublished German patent application DE 10 2005 002 420.3, which is hereby incorporated by reference herein, vacuum cleaner 1 may also have a device 22 that is located in dust chamber 3 and compresses dust bag 5 after fan 12 is turned off, thereby increasing the retention capacity.

Figure 2:
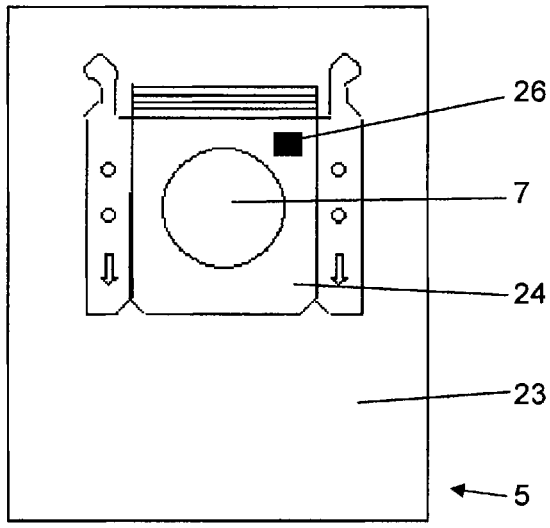
FIG. 2 is a top view of a dust bag 5 according to the present invention, shown in a folded state.

FIG. 2 shows a dust bag 5, including an air-permeable sack 23 made of by paper or nonwoven fabric filter material. Sack 23 has an inlet opening 7 for the air to be filtered, a collar 24 being arranged around the circular inlet opening in order to hold the inlet opening in an aligned position in the dust chamber. As is indicated in FIG. 1, collar 24 is inserted into a mounting member 25 behind the suction opening 8 of dust chamber 3, so that bag 5 is securely held in dust chamber 3. In FIG. 2, it can also be seen that collar 24 is provided with an identifier 26 which is identifiable by the device 19 integrated in electronic control system 17.

Figure 3:
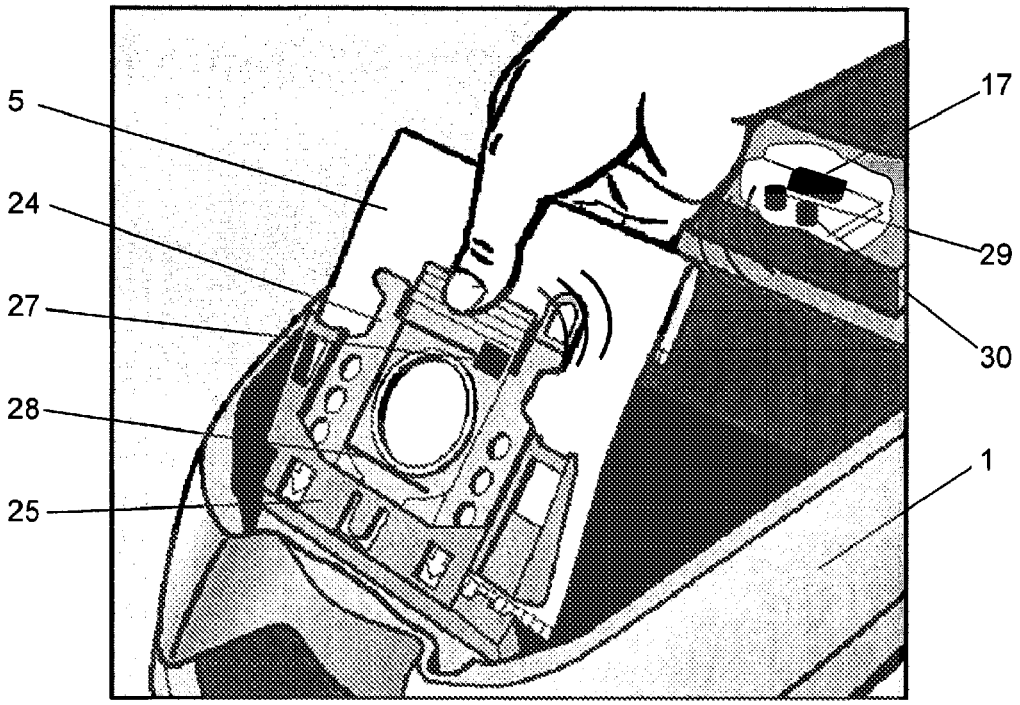
FIG. 3 is a perspective view of a dust chamber into which is insertable a dust bag 5 having a transponder in its collar.

In accordance with a first embodiment, which is shown in FIG. 3, identifier 26 includes a transponder having a chip 27 and an antenna 28 attached to collar 24. In that case, electronic control system 17 of vacuum cleaner 1 is provided with an integrated transponder reading unit including a transmitting device 29, which activates chip 27 and causes it to transmit its stored data, and a receiving unit 30, which receives and further processes this data. The data stored on chip 27 of the transponder includes information such as the type, size and manufacturer of the dust bag. When a dust bag type is identified as appropriate for the respective vacuum cleaner 1, electronic control system 17 can initiate the vacuum cleaning process in the usual manner. If the identification fails, i.e., if either there is no transponder provided on dust bag 5, or if chip 27 contains data that shows that the type of dust bag inserted is inappropriate for vacuum cleaner 1, electronic control system 17 can initiate actions, either individually or in combination, which will reduce the intake of dust into dust bag 5, or parameters which are dependent on the dust intake, such as the drive frequency of replacement indicators. These actions include:

- reducing the fan power, either independently of the selected power, or as a fraction of the selected power;
- prematurely activating the replacement indicator for dust bag 5, motor filter 14, or exhaust filter 15; and
- deactivating the device 22 for compressing dust bag 5, or reducing the performance thereof.

Moreover, the information that an unauthorized or wrong dust bag 5 has been used is stored by electronic control system 17 in non-volatile memory 20. A serviceman can read out this memory and thereby obtain information about improper use.

Figure 4:
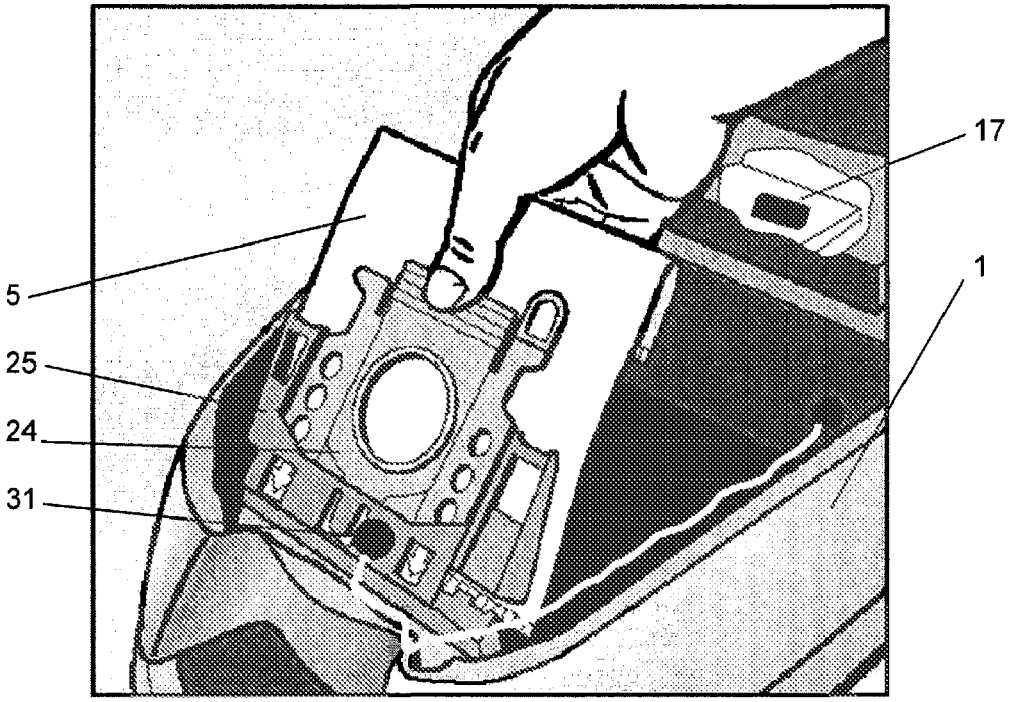
FIG. 4 shows an alternative embodiment according to FIG. 3.

In an alternative approach, which is shown in FIG. 4, the identifier takes the form of a visual mark provided on collar 24. In order to identify this mark, a device 31 for visual pattern recognition is disposed on mounting member 25 in dust chamber 3, the data of said device being analyzed by the electronic control system. In this context, for example, a hologram can be printed or glued on the dust bag collar, said hologram containing, first of all, the company logo. This logo is illuminated by a laser diode and analyzed using a CCD chip. The originality can be verified by comparison with reference data. Secondly, it is also possible to store and read out digital data respectively in and from a hologram. Analogously to the transponder approach, said data then includes information about the size, manufacturer, etc.

The present invention is not limited to the exemplary embodiments described herein.

What is claimed is:

1. A method for operating a vacuum cleaner including a fan, an electronic control system for controlling at least one of the fan and at least one other load, and a dust chamber for receiving an air-permeable dust bag, the method comprising:

providing the dust bag with an identifier;

providing the vacuum cleaner with an identifying device associated with the electronic control system and configured to identify the identifier; and when the identifying device fails to identify the identifier, controlling at least one of the fan and the at least one other load using the electronic control system so as to operate the vacuum cleaner with at least one parameter associated with an intake of dust into the dust bag being reduced.

2. The method as recited in claim 1 wherein the at least one other load includes a display device of the vacuum cleaner.

3. The method as recited in claim 1 wherein the at least one parameter includes a parameter that determines the intake of dust into the dust bag.

4. The method as recited in claim 1 wherein the at least one parameter includes a parameter dependent on a parameter that determines the intake of dust into the dust bag.

5. The method as recited in claim 1 wherein the controlling at least one of the fan and the at least one other load is performed so as to reduce a power of the fan.

6. The method as recited in claim 5 wherein the vacuum cleaner includes a power selecting device configured to select the power of the fan, and wherein the controlling at least one of the fan and the at least one other load is performed so as to reduce the power of the fan independently of a selected power.

7. The method as recited in claim 5 wherein the vacuum cleaner includes a power selecting device configured to select the power of the fan, and wherein the controlling at least one of the fan and the at least one other load is performed so as to reduce the power of the fan to a fraction of a selected power.

8. The method as recited in claim 1 wherein the vacuum cleaner includes at least one of a first replacement indicator for the dust bag and a second replacement indicator for a motor or exhaust filter disposed downstream of the dust bag, and further comprising, when the identifier fails to be identified, prematurely activating at least one of the first and second indicators.

9. The method as recited in claim 1 wherein the vacuum cleaner includes a compressing device disposed in the dust chamber and configured to compress the dust-bag, and further comprising, when the identifier fails to be identified, deactivating or reducing the performance of the compressing device.

10. The method as recited in claim 1 further comprising storing, in a non-volatile memory associated with the electronic control system, information about an identifying or non-identifying of the identifier.

11. The method as recited in claim 1 wherein the identifier includes a transponder and the identifying device includes a transmitter/receiver device configured to activate the transponder.

12. The method as recited in claim 1 wherein the identifier includes a visual mark disposed on the dust bag and the identifying device includes a visual pattern recognition device.

13. The method as recited in claim 12 wherein the visual mark is disposed on a collar of the dust bag.

14. The method as recited in claim 12 wherein the visual mark includes a hologram.

15. The method as recited in claim 1 wherein the dust bag is made of paper or nonwoven fabric.

16. The method as recited in claim 1 wherein the electronic control system is configured to control at least one of a rotational speed and a power of a driving motor of the fan.

* * * * *